US010758049B2

(12) United States Patent
Cooper

(10) Patent No.: US 10,758,049 B2
(45) Date of Patent: Sep. 1, 2020

(54) INFLATABLE AND RECONFIGURABLE PRODUCTS AND METHODS OF MAKING SAME

(71) Applicant: BOTE, LLC, Fort Walton Beach, FL (US)

(72) Inventor: Corey Cooper, Fort Walton Beach, FL (US)

(73) Assignee: BOTE, LLC, Fort Walton Beach, FL (US)

( * ) Notice: Subject to any disclaimer, the term of this patent is extended or adjusted under 35 U.S.C. 154(b) by 0 days.

(21) Appl. No.: 16/153,411

(22) Filed: Oct. 5, 2018

(65) Prior Publication Data

US 2020/0107640 A1 Apr. 9, 2020

(51) Int. Cl.

| | |
|---|---|
| ***A47C 1/14*** | (2006.01) |
| ***A47C 4/00*** | (2006.01) |
| ***A47C 27/08*** | (2006.01) |
| ***A47C 27/10*** | (2006.01) |
| ***A47C 4/54*** | (2006.01) |
| ***A47G 9/08*** | (2006.01) |
| ***A47C 15/00*** | (2006.01) |
| ***A47C 4/28*** | (2006.01) |

(52) U.S. Cl.

CPC ..... *A47C 4/54* (2013.01); *A47C 1/146* (2013.01); *A47C 4/28* (2013.01); *A47C 15/006* (2013.01); *A47C 27/081* (2013.01); *A47G 9/086* (2013.01)

(58) Field of Classification Search

CPC ..... A47C 4/28; A47C 4/54; A47C 15/006; A47C 27/081; A47G 9/086

USPC ..... 297/452.41

See application file for complete search history.

(56) References Cited

U.S. PATENT DOCUMENTS 975,258 A * 11/1910 Kurtz ..... A47C 4/54 297/452.41
2,150,434 A * 3/1939 Finlay ..... A47C 4/54 297/452.41
2,350,679 A * 6/1944 Hann ..... A47C 1/146 297/452.41
2,437,602 A * 3/1948 Hann ..... A47C 4/54 297/452.41 X
2,582,439 A * 1/1952 Kavanagh ..... A47K 3/12 297/452.41 X
2,623,574 A * 12/1952 Damsch ..... A47C 1/146 297/452.41 X
2,764,228 A * 9/1956 Donohue ..... A47C 5/06 297/452.41 X
2,987,735 A * 6/1961 Nail ..... A47C 4/54 297/452.41 X (Continued)

*Primary Examiner* — Rodney B White
(74) *Attorney, Agent, or Firm* — Smith, Gambrell & Russell, LLP

(57) ABSTRACT

Light weight, easily stowed in small spaces inflatable chairs, pads, and flotation devices all from a relatively simple combination of at least two inflatable drop stitch panels which can be held in position relative to each other by use of straps, or in other embodiments, by additional inflatable side panels which provide arms and support to hold the chair upright on the ground. Simple hinges can be used to connect the panels together in desired configurations, either as fixed deployments or as adjustable and convertible deployments, where in one deployment, the panels for a chair, and in another, a flat pad, which can be used as a float or as a ground pad for camping.

8 Claims, 7 Drawing Sheets

(56) References Cited

U.S. PATENT DOCUMENTS 3,408,107 A * 10/1968 Savage ..... A47C 4/54 297/452.41
3,419,309 A * 12/1968 Smith ..... A47C 4/52 297/452.41
3,420,574 A * 1/1969 Smith ..... A47C 4/54 297/452.41
3,499,682 A * 3/1970 Orenstein ..... A47C 4/02 297/452.41
3,572,836 A * 3/1971 Khanh ..... A47C 4/54 297/452.41
3,610,689 A * 10/1971 Smith ..... A47C 4/54 297/452.41
3,635,528 A * 1/1972 Strom ..... A47C 4/02 297/452.41
3,712,674 A * 1/1973 Ando ..... A47C 3/16 297/452.41
3,740,095 A * 6/1973 Nail ..... A47C 15/006 297/452.41
4,932,721 A * 6/1990 Anthony ..... A47C 4/02 297/452.41 X
5,947,563 A * 9/1999 Klimenko ..... A47C 3/16 297/452.41
5,951,111 A * 9/1999 Klimenko ..... A47C 4/54 297/452.41 X
6,042,186 A * 3/2000 Kojic ..... A47C 4/54 297/452.41
6,135,551 A * 10/2000 Linder ..... A47C 4/54 297/452.41 X
6,152,530 A * 11/2000 Hsu ..... A47C 4/54 297/452.41 X
6,161,902 A * 12/2000 Lieberman ..... A47C 4/54 297/452.41
6,206,475 B1 * 3/2001 Tai ..... A47C 4/54 297/452.41 X
6,209,962 B1 * 4/2001 Sobel ..... A47C 3/16 297/452.41 X
6,224,444 B1 * 5/2001 Klimenko ..... A47C 4/54 297/452.41
6,382,729 B1 * 5/2002 Wu ..... A47C 4/286 297/452.41 X
6,886,204 B2 * 5/2005 Kasatshko ..... A47C 4/54 297/452.41
7,131,701 B1 * 11/2006 Yang ..... A47C 4/54 297/452.41
7,370,379 B2 * 5/2008 Zheng ..... A47C 1/146 297/452.41
7,735,931 B1 * 6/2010 Weiner ..... A47C 4/54 297/452.41 X
8,579,372 B2 * 11/2013 Wessman ..... B60N 2/2806 297/452.41 X
8,783,781 B1 * 7/2014 McClure ..... A47C 4/54 297/452.41
9,433,301 B2 * 9/2016 Brechet ..... A47C 27/086
2002/0043869 A1 * 4/2002 Brook ..... A47C 4/54 297/452.41
2002/0101099 A1 * 8/2002 Hughes ..... A47C 4/54 297/452.41 X
2003/0117005 A1 * 6/2003 Becker ..... A47C 4/54 297/452.41
2005/0099054 A1 * 5/2005 McCarthy ..... A47C 15/006 297/452.41
2006/0163935 A1 * 7/2006 Harris ..... A47C 4/54 297/452.41
2009/0085393 A1 * 4/2009 Austen ..... A47C 4/54 297/452.41
2010/0320818 A1 * 12/2010 Li ..... A47C 7/021 297/452.41 X
2011/0089741 A1 * 4/2011 Cyr ..... A47C 4/54 297/452.41
2012/0133190 A1 * 5/2012 Pao ..... A47C 4/54 297/452.41 X
2014/0021768 A1 * 1/2014 Chen ..... A47C 4/54 297/452.41
2015/0265056 A1 * 9/2015 Wang ..... A47C 4/54 297/452.41
2015/0289663 A1 * 10/2015 Berenson ..... A47C 15/006 441/130

* cited by examiner

INFLATABLE AND RECONFIGURABLE PRODUCTS AND METHODS OF MAKING SAME

BACKGROUND OF THE INVENTION

1. Field of the Invention

The present invention relates to products made from drop stitch material that can be inflated for use, and reconfigured for different uses, such as in one configuration the product is inflated and used as a chair, and in another configuration the product is inflated and used as a flotation device. In either or other configurations, the products are light weight and easily stowed and/or carried while requiring the smallest possible space.

2. Description of the Related Art

In my co-pending application Ser. No. 15/904,999, filed Feb. 26, 2018, which is hereby incorporated by reference, I describe the use of drop stitch material used to make boats and the like. Drop stitch material has unique properties mainly related to strength, which allows for inflation to higher levels of pressure. The yarns of essentially equal length, which extend between inner surfaces of the material, prevent uneven bulging. When fully inflated, the drop stitch materials creates panels on the order of a couple inches in thickness which are strong and hard to the point of being comparable to solid plastic or wooden structures. These panels can be shaped and combined to create unique structures, such as the boats described in my prior application.

FIG. 1 is a representative sample of drop stitch material known to be used in making stand up paddle boards, known as "SUPS", and the same material was described for use in my co-pending application. As seen, the drop stitch material 10 typically has a plurality of connecting yarns 12 that extend in equal lengths between two fabric sheets 14 and 16 of woven base cloth. The yarns 12 are stitched to and between the two fabric sheets 14 and 16. The yarns 12 and sheets 14, 16 can be made of nylon and/or polyester or similar material. For strength, air tight, and puncture resistance, PVC inner coatings 18 and 20 and outer coatings 22 and 24 can be applied to the fabric sheets 14 and 16. Additional coatings may be used, or possibly one coating, depending on needs of strength and weight, which are dependent on the type of article being manufactured. Generally, two coatings or layers on each side are preferred. The coatings may be applied in hot liquid form, in which case they are bonded to the fabric sheets when cooled, or they may be applied as pre-formed sheets that are adhesively bonded to the fabric sheets 14 and 16.

By way of example, the base fabric sheets, 14 and 16 can be made from a cloth yarn which is stitched to the connecting yarns 12. Yarns used in both can be 500 denier, for example. The length of the yarns, which determines the thickness of the device when inflated, can be of a desired length, but typically between 5 and 30 centimeters. Each side of the drop stitch material, meaning the upper side and lower side when viewing FIG. 1, where the upper side comprises the combination of fabric sheet 14, inner coating 18 and outer coating 22, can have a thickness of around 1 to 2 millimeters.

In the context of camping and other outdoor sports, both aquatic and terrestrial, a continuing need exists for light, portable yet strong gear. When hiking and camping, a premium is placed on minimizing weight and space. Similar needs exist for aquatic sports, where gear is typically carried from a vehicle to a beach, river or lake, located remotely from motorized transportation. One example is the chair. Examples of portable chairs are replete with structures that fold and deploy, and consist of metal tubing joined by rivets, and covered with seat and arm fabric. No matter how light, these structures nonetheless take up substantial space and by their complexity, are subject to mechanical failure. Moreover, no known chairs are capable of converting from one type of structure to another, e.g., a flotation device for water, to a chair for land.

SUMMARY OF THE INVENTION

The present invention provides improved apparatuses useful in camping and other outdoor activities where space and weight are at a premium.

For example, in one embodiment, an inflatable chair includes a plurality of inflatable sections which, when inflated define a seat panel disposed in a generally horizontal orientation, a back panel disposed in a generally vertical orientation, and two opposite side panels disposed in a generally vertical orientation, and being connectable to the seat and back panels to maintain mutual juxtaposition between all panels. When connected, the inflatable panels form a chair which is light weight, strong enough to support an adult, easily stowable, and completely frameless.

Alternative embodiments include one in which the various inflatable panels are all permanently connected to each other, and in fluid communication so that a single inflation valve can be used to inflate the entire article. When the inflatable panels are assembled after inflation, and held together by detachable coupling means, such as by VELCRO, each section will require a separate inflation valve. Alternative embodiments could include two or more inflatable sections being in fluid communication and sharing a single inflation valve.

In another embodiment, include an article is made of only two inflatable panels, hinged together at abutting end portions, and held in an angled orientation relative to each other by support means. The support means can include straps on opposite sides of the inflatable panels which can be adjusted in length to fix the angled orientation at a desired angle. In a simple chair configuration, the angle of orientation is preferably around 90 degrees. In a ground mat configuration, the straps can be released or detached to allow a 180 degree orientation where the two inflatable panels are substantially coplanar. One aspect of the invention is the ability to convert one article, e.g., a chair, into another article, e.g., a ground mat. A mat can be used as a mattress for sleeping bags, or as a float for aquatic uses. Two chairs, each having two panels, can be positioned in the flat orientation, and aligned end-to-end, to form a longer mat.

Another embodiment of the invention is to connect a third inflatable panel to one of the other two, in accordion fashion, so that in a chair configuration, the seat panel of the chair is formed by two of the panels folded and stacked one on top of the other, while the back panel extends vertically upward from the two stacked panels. Each panel is connected to an adjacent panel by hinge means, which could include the fabric sheets that form the sections, pressed together along one side of the sections, or more preferably, the hinge means can include a strip of flexible material adhesively bonded to the respective, adjacent panels.

DETAILED DESCRIPTION OF THE INVENTION

Figure 1:
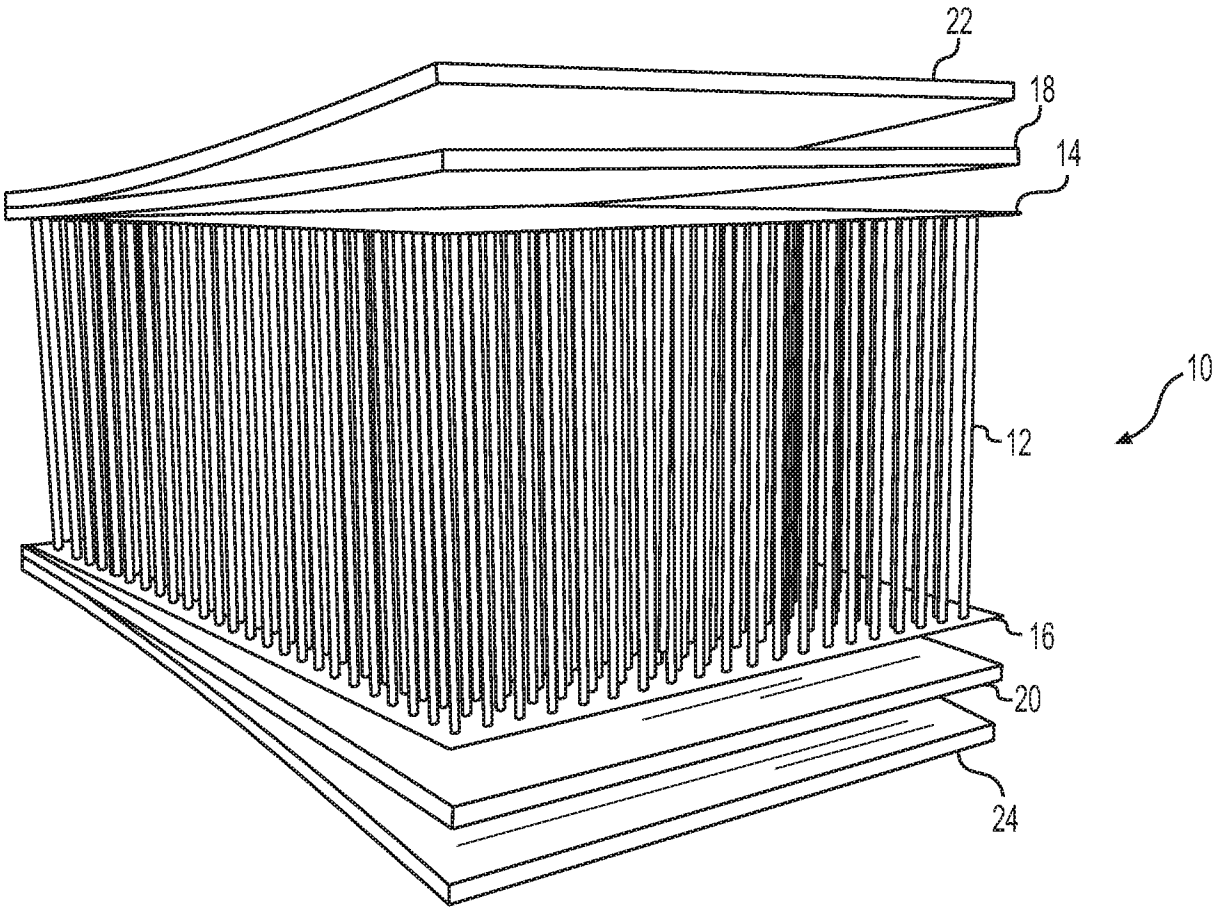
FIG. 1 is an exemplary exploded view of a known form of drop stitch material suitable for use in the present invention.

The present invention provides improved light weight inflatable structures that can be used on land as chairs, mats, cushions, and the like, or on water as a flotation devices, vessels, or the like.

Referring to FIGS. 2 and 3A-3C, a plurality of inflatable, drop stitch panels can be used to make any number of different structures for use on land or on water. Drop stitch materials, or similar materials that create strong, lightweight inflatable panels, can be assembled in different configurations to form articles of furniture, floor or ground mats, or aquatic floats, depending on orientation of the panels relative to each other. In one embodiment, a chair 26 is made from a plurality of inflatable sections which, when inflated define a seat panel 38, disposed in a generally horizontal orientation, a back panel 28 disposed in a generally vertical orientation, and two opposite side panels 30 and 32 disposed in a generally vertical orientation, and being connectable to the seat and back panels 38 and 28 to maintain mutual juxtaposition between all panels. In other words, without the side panels 30 and 32, the seat and back panels 38 and 28 would have no support, and no means to maintain their respective vertical and horizontal orientations. Moreover, the seat and back panels 38 and 28 define the distance by which the side panels 30 and 32 are spaced apart. The width of the seat and back panels 38 and 28 define the spacing between the two side panels 30 and 32. As such, one aspect of the present invention is a frameless chair, unlike other recreational, portable chairs which typically have metal, tubular frames which support fabric backs, seats and arms. Metal frames are disadvantageous in terms of portability and complexity.

Figure 3A:
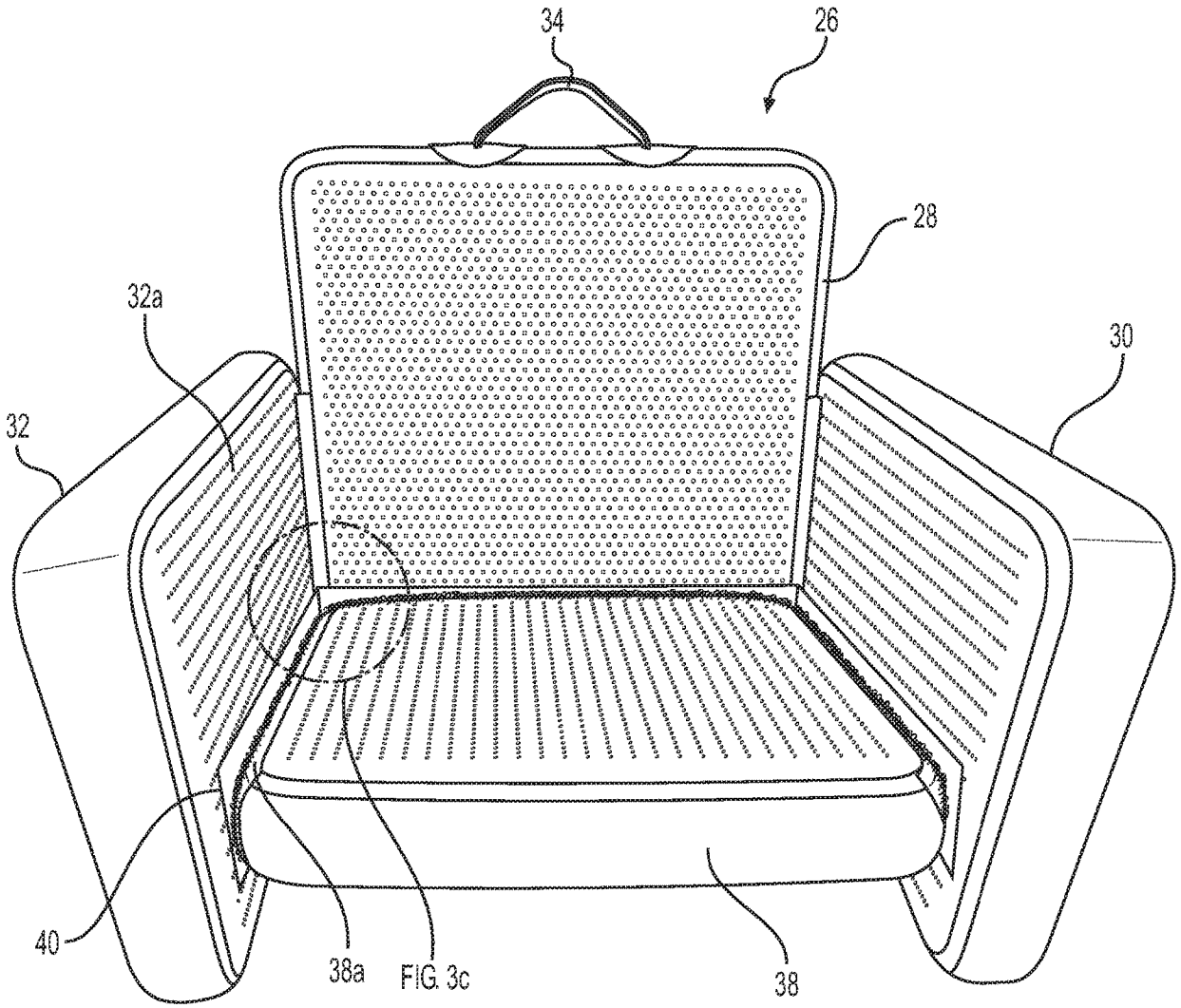
FIG. 3A is a front elevational view of the inflatable drop stitch chair according to the embodiment of FIG. 2.
Figure 3B:
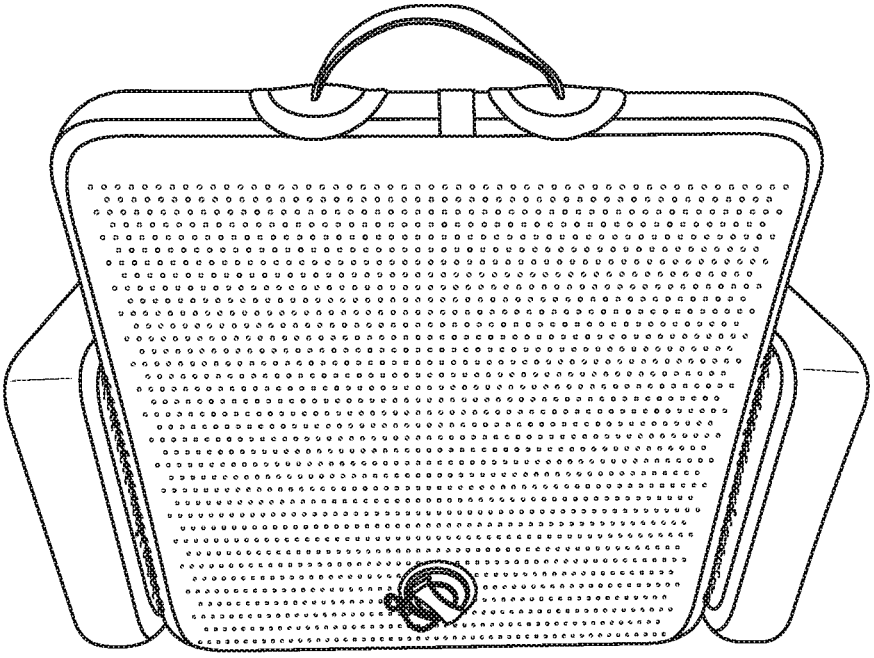
FIG. 3B is a rear elevational view of the inflatable drop stitch chair according to the embodiment of FIG. 2.
Figure 3C:
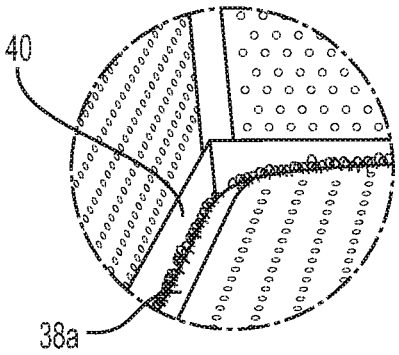
FIG. 3C is an enlarged view of a partial of FIG. 3A.

The seat and back panels 38 and 28 are detachably connected to the two opposite side sections 30 and 32, so that their angle of orientation relative to each other and to the side sections can be varied. One way to facilitate relative adjustment between the back and seat panels is to provide that all panels 30, 32, 38 and 28 are detachably connected to each other by complementary fastener means, such as complementary micro-hook and micro-loop fasteners, commercially available under the name VELCRO. As seen in FIG. 3*a*, side panel 32 has a strip of complementary micro-hooks 40 connected to an inner surface 32*a* of side panel 32. The side surface 38*a* of seat panel 38 has a strip of micro-loop material connected thereto, so that when the seat panel 38 is placed in contact with the side panel 32 as shown in FIG. 3*a*, the two panels adhere detachably and adjustably to each other via the micro-hooks and micro-loops. The detachable aspect comes from the fact that VELCRO type material can be pulled apart, and the adjustable aspect comes from the fact that the angle of orientation of the seat and back panels can be varied according to whether an incline is desired. Similar arrangements of complementary micro-hook and micro-loop fastener material can be arranged for the other panels, as shown in FIG. 3*a*. FIG. 3*b* is an enlarge view showing the corner portion of the chair 26, when connected by VELCRO or other detachable fastening means.

Other fastening means could include complementary snaps, straps, or interlocking members, so that the abutting or adjacent ends of the various panels are detachably connected. When using separate, detachable panels, each panel would be provided with an inflation valve 39. When using separately detachable panels, the chair 26 would be assembled after each panel is inflated.

Figure 4A:
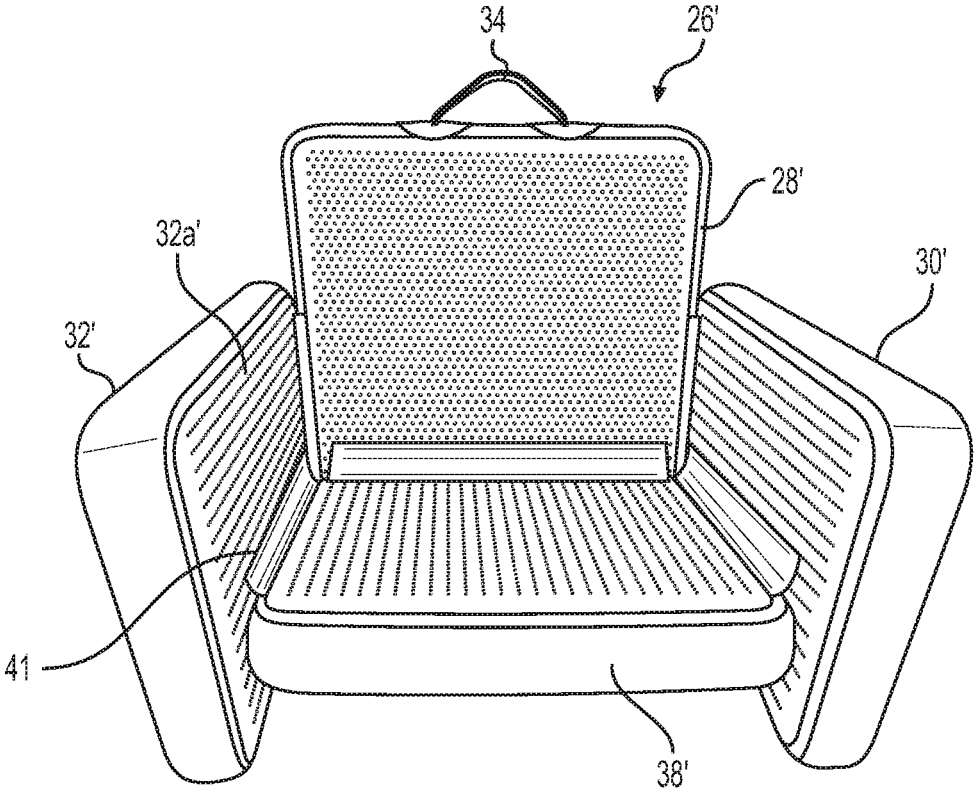
FIG. 4A is a front elevational view of the inflatable drop stitch chair according to another embodiment.
Figure 4B:
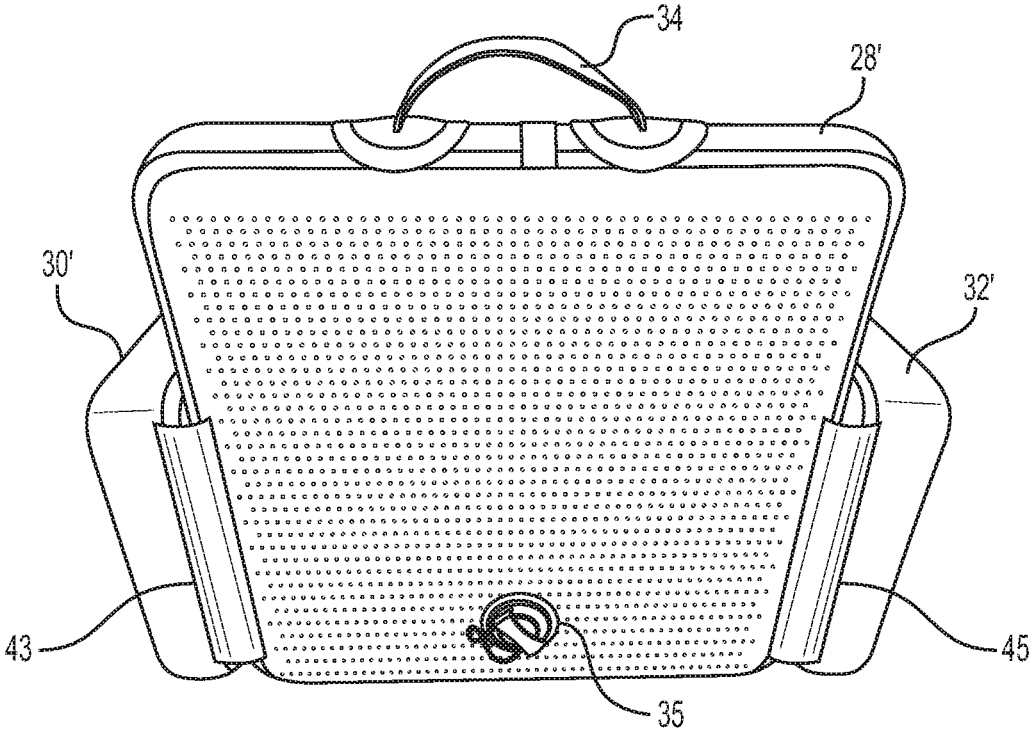
FIG. 4B is a rear elevational view of the embodiment of FIG. 4A.

In another embodiment, shown in FIGS. 4A and 4B, a chair 26' includes panels 38', 28', 30' and 32' are permanently connected to each other through PVC fabric strips 41, 43, 45 that overlap the interface between two adjacent panels. The seat panel 38' and the side panel 32' are connected by a fabric strip partially connected, such as by adhesive, to the inner surface 32*a'* of the side panel 32', and the upper surface of the seat panel 38'. When all panels are permanently connected to each other, they are preferably in fluid communication so that a single inflation valve 36 can be used to inflate all panels.

Generally speaking, each panel is an air tight inflatable member which can either have its own separate inflation valve, or if all panels are in fluid communication with each other, a single inflation valve can be used to inflate all panels. An exemplary inflation valve 36 is shown on the back panel 28 in FIG. 4B. Fluid communication between the different panels can be accomplished by means of any opening between two abutting panels which is adequately sealed.

In all embodiments, each panel is substantially rectangular, and preferably square, and can preferably be anywhere between two and four inches thick. As such, each panel has two opposite ends and two opposite sides. When detachably connected to each other, the seat and back sections 38 and 28 can be disconnected from one another, or connected to each other along a bottom edge portion of the back section and a rearward edge portion of the seat section, in which case they are movable relative to each other by a hinge prior to being connected to the two opposite side panels. The hinge can be a strip of PVC fabric connected by adhesive to both sections and overlapping an interface between the two panels. Alternatively, the seat and back panels 38 and 28 can have an integrally formed hinge which separates two portions of the same panel into the two separate panels.

Figure 2:
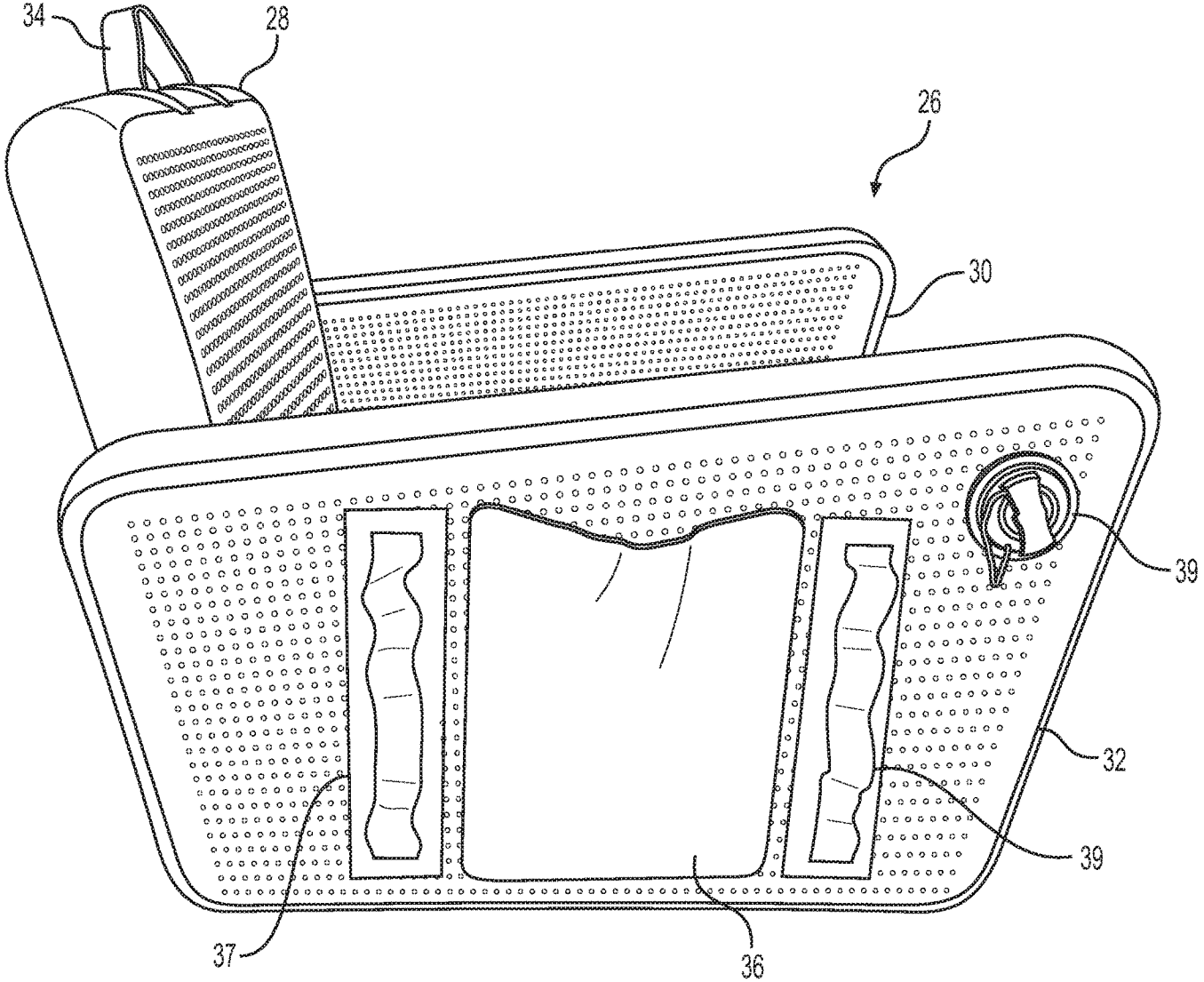
FIG. 2 is a side elevational view of an inflatable drop stitch chair according to one embodiment of the present invention.

The vertical and horizontal orientation of the seat and back sections are adjustably fixed when connected to the two opposite side sections. For example, in the embodiment where all four panels are separate from either other, and connected via complementary fastener means such as VELCRO, the back panel 28 can be set in a position of being substantially vertical as seen in FIG. 2, or it can be set at an incline of anywhere between 45 and 90 degrees relative to the plane of the ground. Once a desired incline angle is selected, the position can be set by fasteners. Similarly, the seat panel 38 can be set at a substantially horizontal position, or at a slight incline relative to the ground. In the case of the seat panel 38, the range of incline is much more limited, to preferably between 0 and 15 degrees, corresponding to a comfort level for someone sitting on the chair 26. In one embodiment, micro hooks and micro loops can be applied to abutting portions of the seat, back and side panels. Other fastener means, such as snaps, ties, clasps, etc., can be used to hold the various panels in fixed but adjustable positions relative to each other.

In the embodiment where all panels are permanently connected to each other, only a single inflation valve 36 is required to inflate the chair 26. In that case, all panels must be in fluid communication with each other. It is equally possible to have an inflation valve for each panel, when the panels are not in fluid communication, or when the panels are all separately made and assembled by fasteners. When the panels are permanently connected, it is possible to use less than four valves, and greater than one, with the number of valves being determined by the particular use, costs involved, ease of manufacture, or other factors.

The present invention includes a method of manufacturing inflatable articles, including the steps of forming a plurality of inflatable sections which, when inflated, define a seat panel 38, a back panel 28, and two opposite side panels 30 and 32. In one embodiment, the panels are separately formed, inflated, and then detachably connected to each other to form an article, such as a chair. Alternatively, the method includes permanently bonding or otherwise connecting the individual panels in orientations that form a back panel extending in a generally vertical orientation, a seat panel extending in a generally horizontal orientation, and two opposite arms panels extending in a generally vertical orientation and at generally right angles to the seat and back. Whether permanently or detachably connected, the panels are inflatable to form an article such as a chair 26. The inflatable panels are preferably made of a drop stitch material which, when inflated, forms rigid yet strong and light weight structural members. The inflatable panels can be fixedly connected to each other by strips of material adhesively bonded to adjacent portions of the inflatable panels, so as to form a single unit that can be inflated by a single inflation valve or by multiple inflation valves, with each additional valve located in a different section. Advantageously, the chair 26 needs no frame or other rigid structural support.

The seat and back panels are fixed in their orientation relative to the two opposite side panels, when all sections are permanently connected to each other, or alternatively, when the sections are independent of each other but detachably coupled when inflated, the seat and back panels are adjustable in their orientation relative to the two opposite side sections. The chair 26 formed by the aforementioned methodology is light weight and easily stowed in a small space. It would be ideal for camping, where light weight equipment eases hiking, particularly on longer routes. When inflated, at a camp site, for example, the chair 26 can be sized to fit a full grown adult, and thus, a camper can relax, rest and rejuvenate for the next phase of the hike. Equally, the chair could be used as a float if, either associated with camping or not. For example, when used on a lakeside camp site, the individual panels can be inflated and used as boogie boards, safety floatation devices and the like. Likewise, the assembled chair 26 can float and be used like a pool float.

In the embodiments of FIGS. 2-4, items of convenience can be attached to the chair 26, such as a handle 34, a pocket 36, and straps 37, 39, which could be used to hold camping items, or could aid in packing the deflated chair 26.

Figure 5:
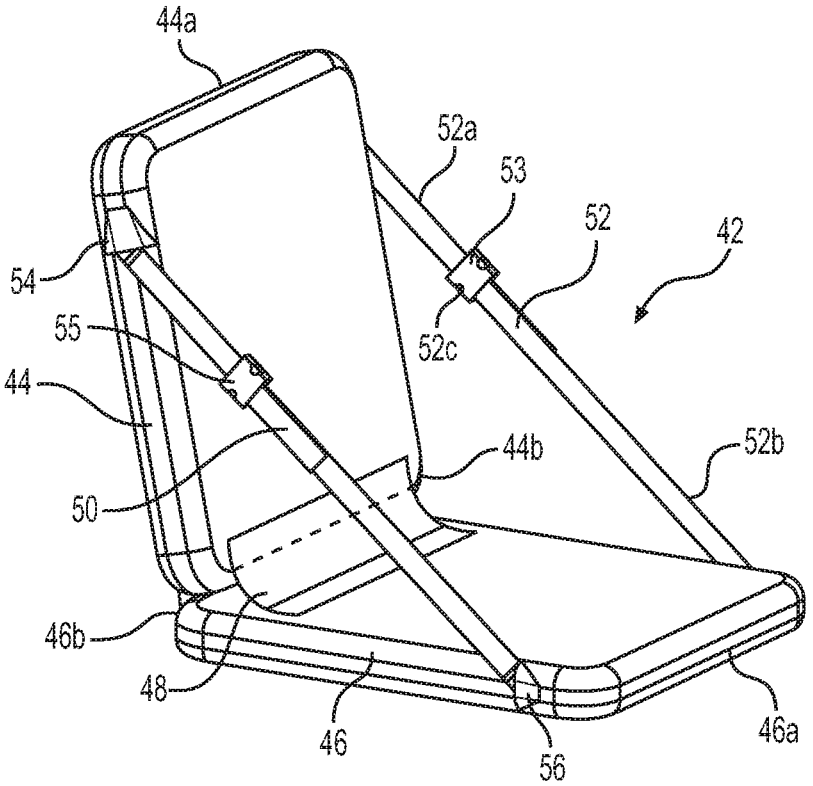
FIG. 5 is a side elevational view of an inflatable drop stitch structure of another embodiment of the present invention, and being shown in a "chair" deployment, where the first and second panels are fixed relative to each other at approximately right angles.
Figure 6:
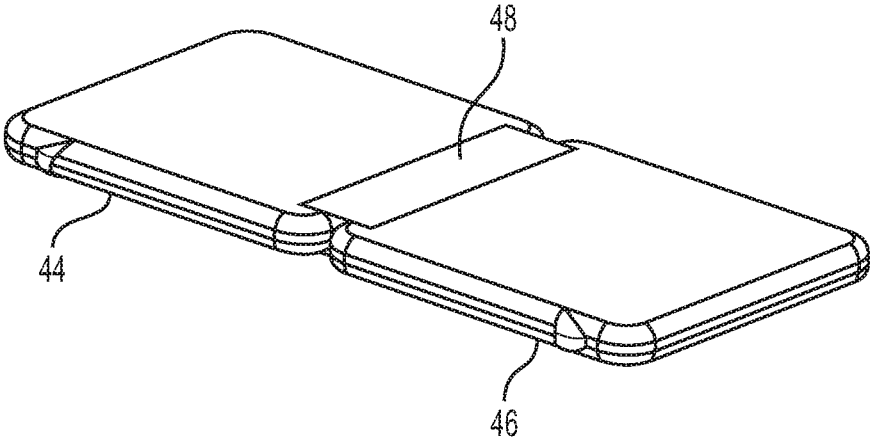
FIG. 6 is a side elevational view of the inflatable drop stitch structure of FIG. 5, where the two panels are disposed in a flat, co-planar, end-to-end deployment to form a ground mat or a flotation device.

Other embodiments of articles according to the present invention include chairs that can be converted to mats. Referring to FIGS. 5-8, an inflatable article 42 includes a first inflatable panel 44 having first and second opposite ends 44*a*, 44*b*, and a second inflatable panel 46 having first and second opposite ends 46*a*, 46*b*. The first and second panels 44 and 46 are movably connected to each other at their abutting ends 44*b* and 46*b* by means of a hinge 48. The hinge 48 can be a strip of PVC fabric overlapping the abutting ends 44*b* and 46*b* and adhesively connected to both panels. Since the fabric is flexible, and permanently connected to the panels, the two panels can be moved, or rotated relative to each other, to allow the panels 44 and 46 to move and be positioned relative to each in a range of approximately 360 degrees. In FIG. 5, the two panels 44 and 46 are at 90 degrees to each other, and can be locked in that position by straps 50 and 52. From the view of FIG. 5, the assembled panels 44 and 46 form a clam shell type structure, where the first panel 44 is capable of being rotated clockwise to lay flat on the second panel 46, in which case, the article 42 could be used as a cushion, a back-less chair, stoop, or flotation device. Couplings 53 and 55 can be disconnected to allow panels 44 and 46 to rotate relative to each other counterclockwise, until the two panels lay flat, in substantially the same plane, as seen in FIG. 6. In the FIG. 6 deployment, the article could be used as a ground mat, or flotation device.

Straps 50 and 52 can be adjusted to fix the relative position of the two panels. In the FIG. 5 deployment, the straps 50 and 52 hold the panels 44 and 46 at a generally right angle to each other, in which case, the first panel 44 functions as a back panel and the second panel 46 functions as a seat panel. A more reclined orientation of the back panel 44 can be achieved by adjusting the length of the straps 50 and 52. The straps 50 and 52 have detachable first and second portions, as seen for strap 52 as first and second portions 52*a* and 52*b*, either of which can be of adjustable length, and both being connected to each other via the coupling 53 which is preferably a complementary clasp of the type that can be squeezed to disengage and pulled apart. The strap portions 52*a* and 52*b* can be permanently connected at opposite ends to the two panels 44 and 46 by coupling 54 and 56, of the same type as coupling 53, 55, or alternatively, they could be detachably coupled with couplings 54, 56, having a first portion connected to the respective panels, and a second portion connected to the ends of corresponding strap portions. The straps 50 and 52 provide means for fixing a position of the first and second inflatable panels 44 and 46 relative to each other. In any event, both panels 44 and 46 are preferably made of a drop stitch material.

The hinge 48 is preferably a strip of flexible material overlapping and fixedly adhered to the first and second inflatable panels at the adjacent ends. The straps 50 and 52 provide means for fixing the angle of rotation between the two panels 44 and 46, although the straps would not prevent panels 44 and 46 from collapsing on top of each other. In the preferred embodiment, the straps prevent counter-clockwise rotation, in a way that a user sitting on the second panel 46, cannot push the first panel 44 downwardly with his or her back. By using straps, the goal of achieving frameless articles can be maintained. The pair of adjustable straps 50 and 52 are adjustably and releasably connected to the panels to provide the first and second inflatable panels a range of relative positioning between each other of between 0 and 180 degrees.

Figure 7:
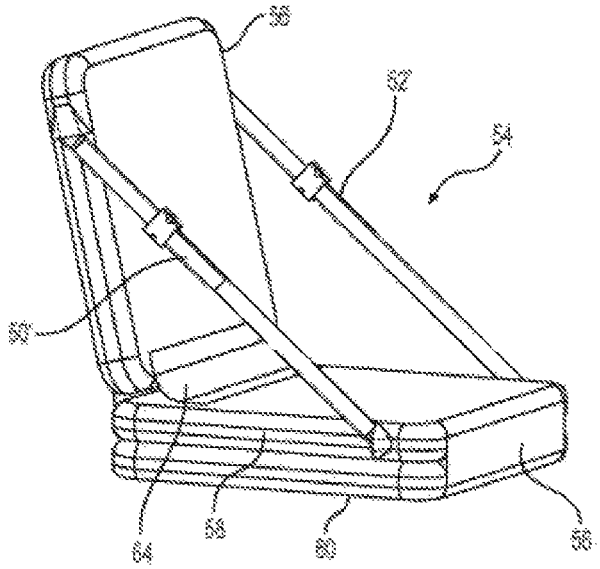
FIG. 7 is a side elevational view of an inflatable drop stitch structure of another embodiment of the present invention, and being shown in a "chair" deployment, where two panels are folded on top of each other, and a third panel is rotated approximately to a right angle relative to the other two panels.
Figure 8:
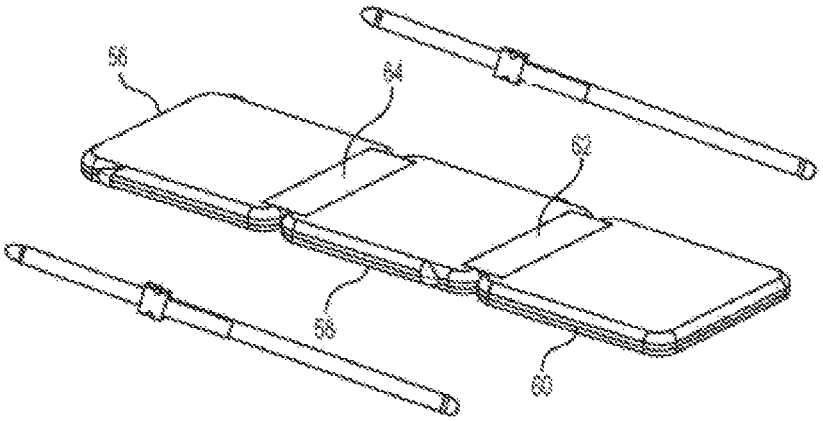
FIG. 8 is a side elevational view of the inflatable drop stitch structure of FIG. 7, where the three panels are disposed in a flat, co-planar, end-to-end deployment to form a structure useful on land as a ground mat or on water as a flotation device.

The first and second inflatable panels 44 and 46 have first and second opposite sides, and the hinge 48 is connected to adjacent ends of the first and second panels. Additional panels can be added to increase the length, or width, of the article. As seen in FIGS. 7 and 8, an article 54 includes a first panel 56, a second panel 58, and a third panel 60. Hinge 62 connects the third panel 60 to the second panel 58, and hinge 64 connects the second panel 58 to the first panel 56. Hinges 62 and 64 are similar to hinges described in the previous embodiments, as a strip of PVC flexible fabric overlapping adjacent ends of respective panels, and permanently adhered to end portions of each, by adhesives or other suitable means. The first and second hinges 62 and 64 permit a range of movement between the first, second and third inflatable panels between one where all three inflatable panels are all aligned in the same plane in one deployment, seen in FIG. 8, to one where one inflatable panel is oriented at an angle to the other two inflatable panels, as seen in FIG. 7.

The three inflatable panels 56, 58, 60 are movable and adjustably fixed relative to each other to form in different deployments a chair and a flat pad. When laid out flat, as seen in FIG. 8, the panels can be used as a mattress for campers, a pool or lake side pad for sunning, or equally, for floating and paddling on water. In a chair deployment, the article 54 can be a back-less chair, where all three panels are stacked on top of each other, or as a backed chair, where the seat comprises two of the three panels and the back is the third panel. Although in the FIGS. 7 and 8 embodiment, hinges are used to connect the three panels, a VELCRO arrangement could also be used to connect the three panels in detachable format. This would give an advantage in having three separate flotation devices for Coast Guard safety regulations, so that if the article were used on power boats or sailboats, a cockpit chair could be configured, which could be quickly and easily broken down into separate man-over-board flotation devices.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. An apparatus comprising:

a plurality of inflatable sections that, when inflated, define an article comprising:

a seat panel disposed in a generally horizontal orientation;

a back panel disposed in a generally vertical orientation; and two opposite side panels disposed in a generally vertical orientation, wherein the plurality of inflatable sections are each made of an inflatable drop stitch material, and are each permanently connected to one another, with the two opposite side panels connected to the seat and back panels to maintain mutual juxtaposition between all sections, and the two opposite side panels both comprise a first lower surface adapted to rest on a ground and a second upper surface adapted to act as an arm rest, the seat panel comprises a first lower surface positioned to be an under-seat surface and a second upper surface adapted to be a user support surface, and the apparatus is configured such that, when inflated to define the article, the seat panel is supported by the two opposite side panels with the first lower surface of the seat panel residing at a higher elevation than an elevation at which the first lower surfaces of the two opposite side panels reside.

2. The apparatus of claim 1, wherein seat and back panels are connected to one another along a bottom edge portion of the back panel and a rearward edge portion of the seat panel, and are movable relative to one another by a hinge.

3. The apparatus of claim 2, wherein vertical and horizontal orientation of the seat and back panels are adjustably fixed.

4. The apparatus of claim 1, wherein each of said plurality of inflatable sections are in fluid communication with each other, and wherein one of said plurality of inflatable sections includes an inflation valve that is operable to inflate each of said plurality of inflatable sections.

5. A method of manufacturing comprising:

forming a plurality of inflatable sections that, when inflated, define an article comprising a seat panel, a back panel, and two opposite side panels, wherein the plurality of inflatable sections are each made of an inflatable drop stitch material, and are each permanently connected to one another, and when inflated define the article with the back panel extending in a generally vertical orientation, the seat panel extending in a generally horizontal orientation, and the two opposite side panels extending in a generally vertical orientation and at generally right angles to the seat and back panels, and the two opposite side panels both comprise a first lower surface adapted to rest on a ground and a second upper surface adapted to act as an arm rest, the seat panel comprises a first lower surface positioned to be an under-seat surface and a second upper surface adapted to be a user support surface, and the apparatus is configured such that, when inflated to define the article, the seat panel is supported by the two opposite side panels with the first lower surface of the seat panel residing at a higher elevation than an elevation at which the first lower surfaces of the two opposite side panels reside.

6. The method of claim 5, wherein the plurality of inflatable sections are fixedly connected to one another by strips of material adhesively bonded to adjacent inflatable sections.

7. The method of claim 5, wherein the seat and back panels are fixed in their orientation relative to the two opposite side panels.

8. The method of claim 5, wherein the seat and back panels are adjustable in their orientation relative to the two opposite side panels.

* * * * *